US007066463B2

(12) United States Patent
Zembko et al.

(10) Patent No.: US 7,066,463 B2
(45) Date of Patent: Jun. 27, 2006

(54) SYSTEM AND METHOD FOR SHEET TRANSPORTING USING DUAL CAPSTAN ROLLERS

(75) Inventors: Michael C. Zembko, Andover, MA (US); John W. Berrigan, Nashua, NH (US); John L. Connolly, Newton, NH (US)

(73) Assignee: ECRM Incorporated, Tewksbury, MA (US)

( * ) Notice: Subject to any disclaimer, the term of this patent is extended or adjusted under 35 U.S.C. 154(b) by 248 days.

(21) Appl. No.: 10/117,337

(22) Filed: Apr. 8, 2002

(65) Prior Publication Data

US 2003/0188648 A1 Oct. 9, 2003

(51) Int. Cl.
*B65H 5/04* (2006.01)

(52) U.S. Cl. ..... 271/272; 271/265.01; 271/264; 271/902; 271/314; 400/636; 400/637; 400/656

(58) Field of Classification Search ..... 271/272, 271/225, 184, 902, 314, 264, 265.01; 400/636, 400/656, 637
See application file for complete search history.

(56) References Cited

U.S. PATENT DOCUMENTS

| | | | | | |
|---|---|---|---|---|---|
| 4,558,373 | A | * | 12/1985 | Plasencia et al. | 358/484 |
| 4,729,557 | A | * | 3/1988 | Kiyohara | 271/272 |
| 4,843,435 | A | | 6/1989 | Horiguchi et al. | |
| 4,947,190 | A | * | 8/1990 | Mizusawa et al. | 347/33 |
| 5,074,547 | A | | 12/1991 | Smith et al. | |
| 5,193,800 | A | * | 3/1993 | Kashiwabara | 271/272 |
| 5,331,338 | A | | 7/1994 | Mager | |
| 5,488,467 | A | * | 1/1996 | Marentes et al. | 399/68 |
| 5,602,571 | A | * | 2/1997 | Suda et al. | 346/134 |
| 5,636,928 | A | | 6/1997 | Shiina et al. | |
| 5,754,913 | A | | 5/1998 | Bar-Lev | |
| 5,762,431 | A | * | 6/1998 | Pawelka et al. | 400/642 |
| 5,789,727 | A | * | 8/1998 | Teradaira et al. | 235/449 |
| 5,938,193 | A | | 8/1999 | Bluemle et al. | |
| 5,988,907 | A | * | 11/1999 | Iso | 400/637 |
| 6,022,015 | A | * | 2/2000 | Matsumoto | 271/121 |
| 6,089,567 | A | * | 7/2000 | Yatsuhashi et al. | 271/314 |
| 6,345,819 | B1 | * | 2/2002 | Bae | 271/272 |
| 6,545,636 | B1 | * | 4/2003 | Shaklee et al. | 347/262 |
| 6,722,649 | B1 | * | 4/2004 | Yui | 271/184 |
| 2003/0155706 | A1 | * | 8/2003 | Tsutoh | 271/272 |
| 2004/0178565 | A1 | * | 9/2004 | Reeves | 271/225 |
| 2004/0256794 | A1 | * | 12/2004 | Barthold et al. | 271/272 |
| 2005/0067775 | A1 | * | 3/2005 | Ono | 271/272 |
| 2005/0098943 | A1 | * | 5/2005 | Nam | 271/272 |

FOREIGN PATENT DOCUMENTS

| | | | | |
|---|---|---|---|---|
| EP | 1 092 661 | A1 | | 4/2001 |
| GB | 2 132 737 | A | | 7/1984 |
| JP | 60-118542 | | | 6/1985 |
| JP | 61-178334 | | | 8/1986 |
| JP | 363224950 | | | 9/1988 |
| JP | 1-256440 | | | 10/1989 |
| JP | 1-267228 | | | 10/1989 |
| JP | 2-144343 | | | 6/1990 |
| JP | 05147798 | A | * | 6/1993 |
| JP | 05147800 | A | * | 6/1993 |
| WO | WO 00/12316 | | | 3/2000 |
| WO | WO 00/49463 | | | 8/2000 |

OTHER PUBLICATIONS

Jul. 29, 2003. International Search Report from PCT/US03/09602.

* cited by examiner

*Primary Examiner*—Donald P. Walsh
*Assistant Examiner*—Matthew J. Kohner
(74) *Attorney, Agent, or Firm*—Wilmer Cutler Pickering Hale & Dorr LLP

(57) ABSTRACT

A platesetting system and method comprising a pair of dual capstan rollers that receives a recording medium and records an image on the received medium as the medium is transported through the system. The system and method advantageously enable at least a portion of the image to extend from a leading edge of the medium to a trailing edge of the medium.

62 Claims, 8 Drawing Sheets

SYSTEM AND METHOD FOR SHEET TRANSPORTING USING DUAL CAPSTAN ROLLERS

BACKGROUND OF THE INVENTION

The present invention relates generally to transporting media and, more particularly, to transporting media in a platesetter imaging system.

In platesetting imaging systems in which media (e.g., metal and/or plastic sheet) are moved, conventional capstan drives cannot expose or form an image over an entire length of the media from end-to-end (i.e., from a leading edge of the media to a trailing edge of the media). This results in inefficient use of media, and use of a media size that is necessarily larger than an image formed thereon.

There remains a need for a platesetter media transport and imaging system that provides end-to-end use of media, as well as a substantially consistent image quality throughout the entire image.

SUMMARY OF THE INVENTION

It is a feature and advantage of the present invention to provide a platesetter imaging system, having dual capstan rollers, that can record images over substantially the entire surface of a recording medium.

This and other objects of the present invention are realized in a system and method that, in at least one embodiment, feature two sets of capstan rollers, each having a driven roller and a non-driven roller, that translate media at a substantially same speed in forward and reverse directions through an imaging plane. As used herein, an imaging plane is where focused scanning laser light moves in a substantially straight line to create an image on the media. The capstan rollers have a substantially flat surface positioned between them to support the recording media. In at least one embodiment, the media is initially positioned using alignment pins to register the medium in a conventional manner known in the art. Subsequent to registration, the capstan rollers engage the media, and the reference pins simultaneously or subsequently move down so that they do not obstruct the path of the media during imaging. Initially, the media is moved back (right-to-left when viewed from FIG. 1) so that the leading edge of the media is a sufficient distance from the second driven and non-driven roller to enable each of the first and second set of driven and non-driven rollers to accelerate to respective angular velocities that provide a substantially same speed at the periphery of the each of the first and second sets of driven and non-driven rollers. The angular velocities of, for example, the first and second driven (and non-driven) rollers may be slightly different due to differences in their respective diameters.

Subsequent to achieving positioning of the medium, the rollers are then preferably stopped. The rotational direction of the rollers is then reversed to start exposing, optionally from substantially up to and including the leading (i.e., the edge closest to the reference pins) and/or trailing edge (i.e., the edge farthest from the reference pins) of the medium.

In at least one embodiment, the first non-driven roller has a first horizontal offset from the first driven roller, and the second non-driven roller has a second horizontal offset from the second driven roller. We have discovered that these offsets advantageously prevent or reduce the tendency of the media from "wrapping around" the driven rollers, thereby minimizing or substantially eliminating imaging artifacts. The first horizontal offset is in a direction in which the medium is received in the platesetter and is approximately ten thousandths of an inch (0.010 inch). The second horizontal offset is in a direction in which the medium exits from the platesetter, and also is approximately ten thousandths of an inch (0.010 inch). We have also discovered that use of a plurality of independent shafts for each roller or group thereof also provides a substantially uniform force applied to the medium. This ensures that the medium is moved in a substantially straight direction.

In at least one embodiment, a separate motor is provided for each of the two driven rollers. A controller, for example, receives as input the speed at a periphery of each of the driven rollers, and controls the motors to provide a substantially same speed at the periphery of each driven roller taking into account, for example, a small variation or difference in diameter of the two driven rollers. This advantageously ensures that the medium is transported at a constant speed through the two sets of rollers, thereby minimizing and preferably eliminating imaging artifacts that may be caused by differences in speed at the periphery of each driven roller. In at least one embodiment, the controller can utilize different gains, a function of at least velocity of the medium, to minimize system disturbances and/or imaging artifacts from the medium coming into contact with the second set of rollers during imaging.

Using two sets of rollers, the system and method in accordance with the present invention can optionally and advantageously image onto media substantially from end-to-end, leaving no area of the media unexposed. In addition, the system and method in accordance with the present invention advantageously saves time by, for example, loading, imaging, and unloading media in a single low cost, full image operation. Finally, the dual capstan imaging system in accordance with the present invention enables imaging to be done in a manner that does not adversely affect the image being laid down on the medium.

Before explaining at least some embodiments of the invention in detail, it is to be understood that the invention is not limited in its application to the details of construction and to the arrangements of the components set forth in the following description or illustrated in the drawings. The invention is capable of other embodiments and of being practiced and carried out in various ways.

BRIEF DESCRIPTION OF THE DRAWINGS

The Detailed Description including the description of a preferred structure as embodying features of the invention will be best understood when read in reference to the accompanying figures wherein.

DETAILED DESCRIPTION OF A PREFERRED EMBODIMENT OF THE INVENTION

Figure 1:
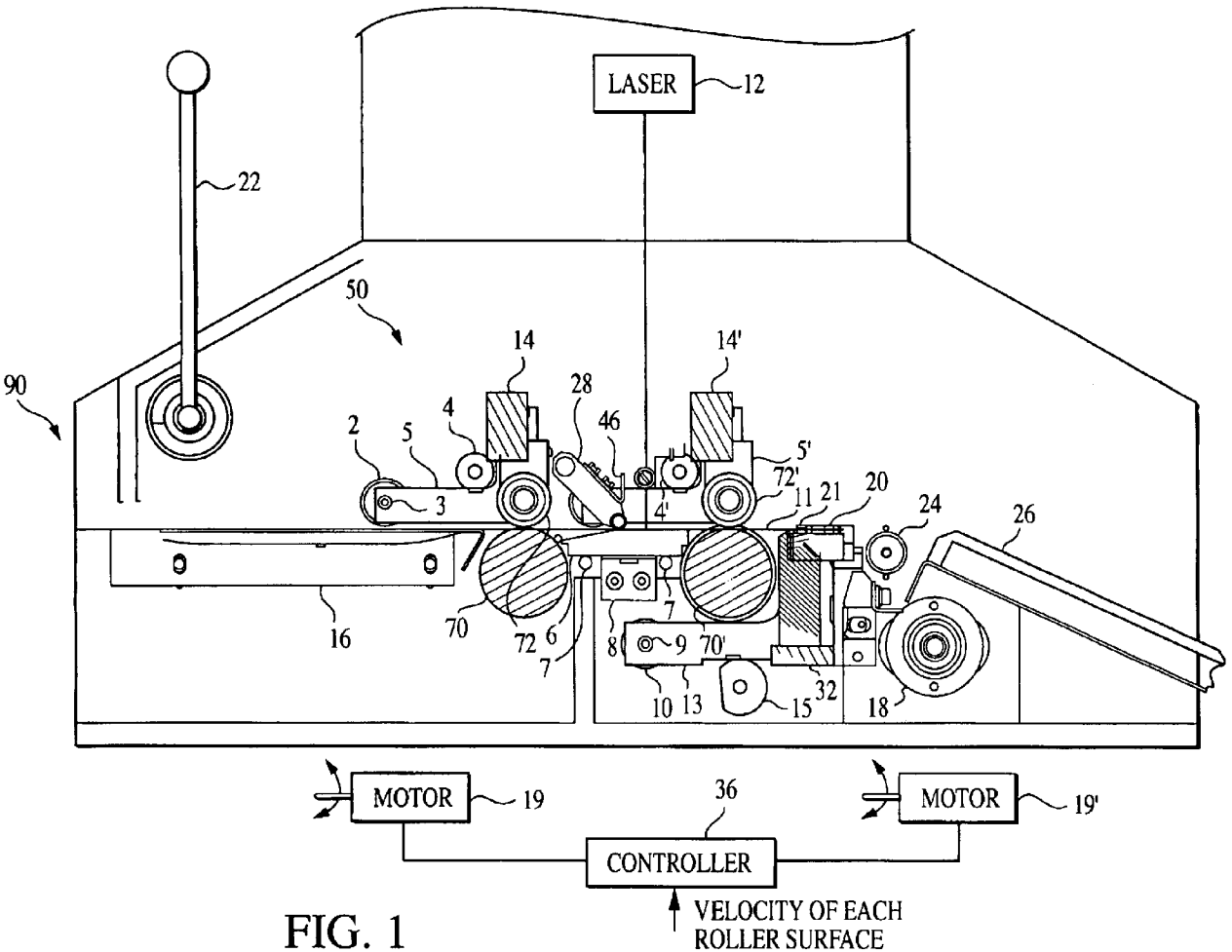
FIG. 1 is an elevation view of an exemplary platesetter imaging system embodying the present invention.

Referring now to the drawings, FIG. 1 shows a platesetter imaging system, generally designated 90, in which a precision image is recorded on a medium 11 as the medium 11 is advanced (initially from right-to-left during pre-imaging transport of the medium 11, and subsequently from left-to-right during imaging, and) from a receiving surface 16 through platesetter 90 to an exit ramp 26. The receiving surface 16 enables, for example, a user to manually feed the medium 11 into the system 90. The medium can also be automatically fed into the system 90. In platesetter 90, the media is exposed by a laser 12 as the medium 11 passes over a platen 6. The platen 6 can be secured in place by, for example, pins 7. A bracket 8 can optionally be utilized to provide additional support for platen 6.

Platesetter 90 has a media transport system 50 having a first set of paired rollers 70, 72 and a second set of paired rollers 70', 72' arranged for substantial end-to-end imaging of media 11. A gravity operated pressure roller 28 is optionally provided to facilitate keeping the media 11 in contact with the platen 6. A pin assembly having a plurality of alignment pins 20, 21 is used for mechanically aligning, and subsequent electronically registering the media 11 in a conventional manner. As is known in the art, registering the medium 11 generally involves properly placing the medium 11 within the system 90 so that the laser 12 and/or other imaging can image the medium 11 in the intended or designated area of medium 11. An idler roller 24 is provided for facilitating transport of media 11 from rollers 70', 72', and onto exit ramp 26. As shown, idler roller 24 can rotate about a shaft or pin.

Rollers 70 and 70' are preferably made of aluminum and have a precision diameter (e.g., diameter constant within tolerances of, for example, ±0.0002 or ±0.0001 inches (±5.0 or ±2.5 microns)). Roller 70' is driven by a pulley 18 and motor 19'. A first belt (not shown) operationally engages the pulley 18 and motor 19'. A second belt (not shown) operationally engages pulley 18 and a pulley coupling (not shown) that is operationally engaged with roller 70'. An arrangement using a single belt that engages the pulley 18, motor 19', and roller 70' can also optionally be utilized. A similar pulley (not shown) and motor 19 arrangement is utilized for roller 70. Rollers 70 and 70' each rotate about separate shafts 74, 74' (FIG. 2) positioned within a substantially central portion of the rollers 70, 70'.

The outer surface of rollers 70, 70' should have a substantially same (and constant) speed to provide for a substantially constant media 11 speed and to avoid imaging artifacts. Preferably using conventional instrumentation, controller 36 receives as inputs the velocity at the surface of rollers 70, 70' and adjusts the speed of motors 19, 19' accordingly. A conventional rotary encoder (not shown) can be used in conjunction with each roller 70, 70' to determine their respective angular velocity. Knowing the diameter of each roller 70, 70' as well as their respective angular velocity, the speed at the surface of each roller 70, 70' can be obtained. For example, if the diameter of roller 70 is 0.0001 inch smaller than that of roller 70', then motor 19 will have to drive roller 70 at a slightly faster angular velocity than that of roller 70' in order to achieve the substantially same speed at the surface of the rollers 70, 70'. The controller 38 can have conventional phase lock loop motor speed control chips (not shown). Subsequent to measuring the speed at the surface of each roller 70, 70', the ratio of the speeds can be utilized to adjust and determine the ratio of the speeds of respective motors 19', 19. Rollers 72, 72' are preferably made from rubber, and are shown more clearly in FIGS. 6 and 7 and will be described in further detail herein.

The controller 36 can synchronize motors 19, 19' at a plurality of speeds to accommodate various medium thicknesses and/or imaging densities as expressed, for example, in dots per inch. In at least one embodiment, the gain of the controller is set in conjunction with the rotational speed of the driven rollers 70, 70' (and hence the speed of medium 11) to minimize system disturbances and/or imaging artifacts from the medium 11 coming into contact with the second set of rollers during imaging.

It will be noted that the tops of rollers 70, 70', the top surface of platen 6, and the top of idler roller 24 lie in substantially the same horizontal plane. In a preferred embodiment, rollers 70, 72 and 70', 72' do not, however, lie in the same vertical plane. Specifically, it is preferred that roller 72 be horizontally offset to the left (e.g., closer to handle 22) of roller 70 by approximately 0.010 inches. It is also preferred that roller 72' be horizontally offset to the right (e.g., closer to idler roller 24) of roller 70' by approximately 0.010 inches. Roller 72 can be held in place by the L-shaped arm 5, arm holder 2, and pin 3. Roller 72' can be held in place by the same or a similar arrangement or configuration, as shown in FIG. 1. Additional elements shown in FIG. 1 will be discussed herein.

Figure 2:
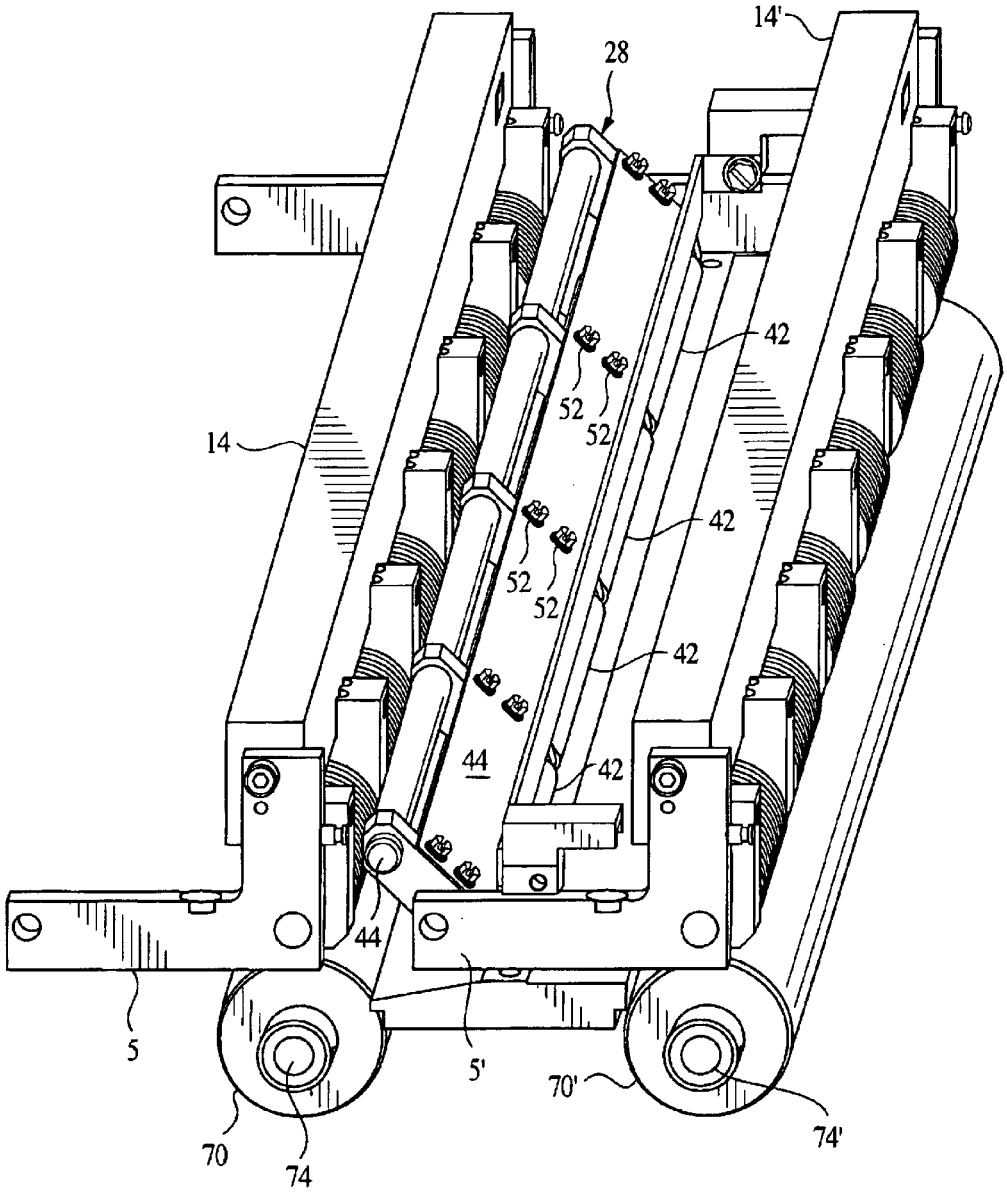
FIG. 2 is an exemplary perspective view of the upper and lower roller arrangement of the platesetter imaging system of FIG. 1.

FIG. 2 is an exemplary perspective view of the upper and lower roller arrangement of the platesetter imaging system 90 of FIG. 1. As is also shown in FIG. 2, pressure roller 28 preferably has a plurality of rollers 42 that contact the medium 11. As shown in FIG. 1, the pressure roller 28 can be secured in place by, for example, a bracket 46 using one or more of the sets of screws or bolts 52. Other mounting and/or securing techniques can also be utilized. Frame 14 is attached to L-shaped arm 5. Similarly, frame 14' is attached to L-shaped arm 5'. With regard to FIG. 1, L-shaped arm 5 can be similarly secured to arm holder 2 by a pin 3. L-shaped arm 5' can be secured in the same or a similar manner. Other securing, mounting or fastening techniques can also be utilized to secure L-shaped arms 5, 5'. FIG. 1 also shows an L-shaped frame 13, arm holder 10 and pin 9 similar to that of frame 5.

Figure 3A:
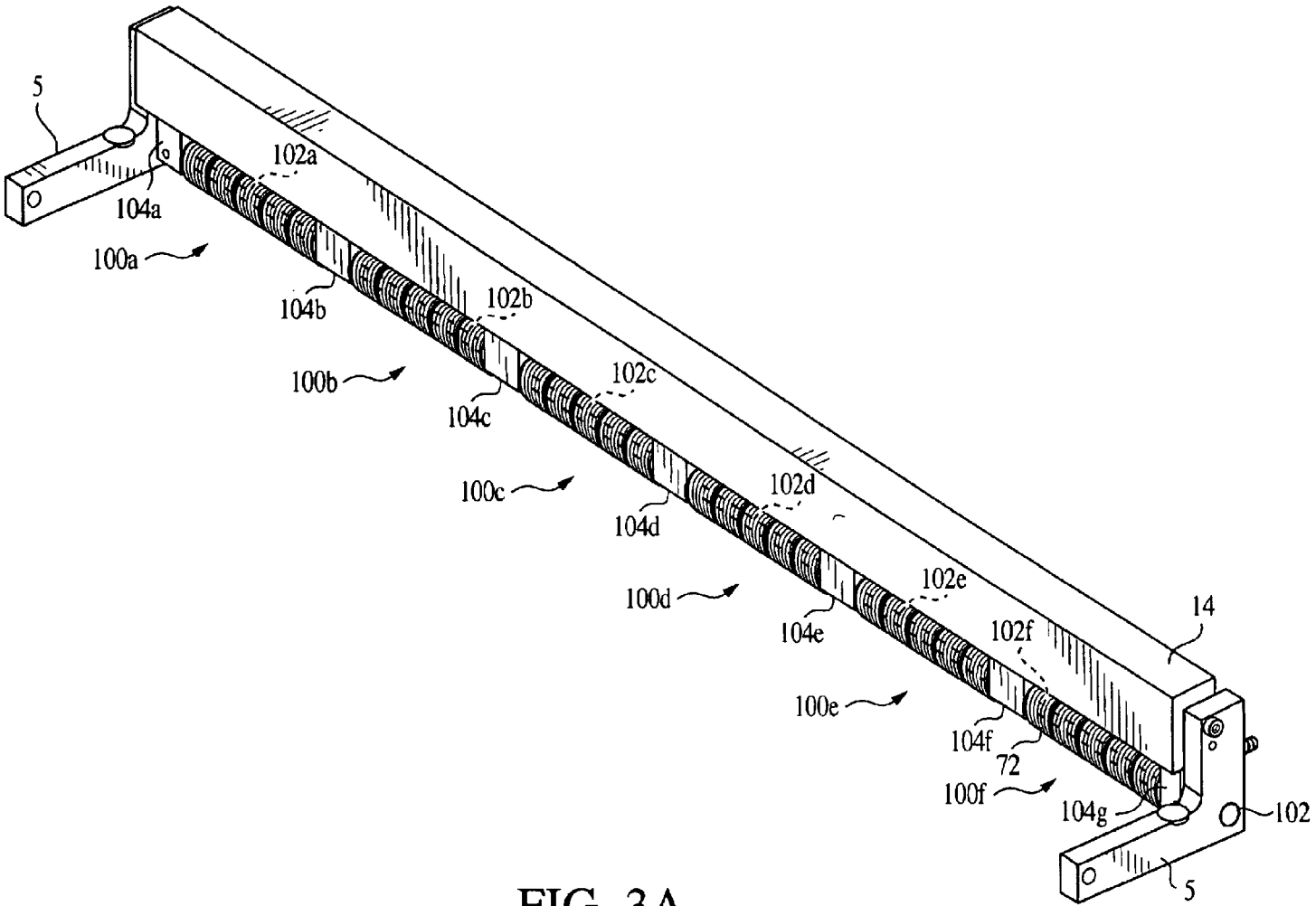
FIG. 3A is an exemplary perspective view of the upper roller arrangement of the platesetter imaging system, showing additional details regarding roller arrangement.

FIG. 3A is an exemplary perspective view of the upper roller arrangement of the platesetter imaging system 90 of FIG. 1. As shown, frame 14 has supports 104*a*, 104*b*, 104*c*, 104*d*, 104*e*, 104*f*, and 104*g* (104*a*–104*g*). Between each pair of adjacent supports (e.g., 102*a* and 102*b*, 102*b* and 102*c*, etc.) is a shaft 102*a* 102*b*, 102*c*, 102*d*, 102*e*, and 102*f* (102*a*–102*f*) that is used for each set of respective roller sections 100*a*, 100*b*, 100*c*, 100*d*, 100*e*, and 100*f* (100*a*–100*f*). We have discovered that the use of separate shafts 102*a*–102*f* associated with each of the respective roller sections 100*a*–100*f* facilitates transport of the media 11 in a linear manner, thereby avoiding imaging artifacts.

Figure 3B:
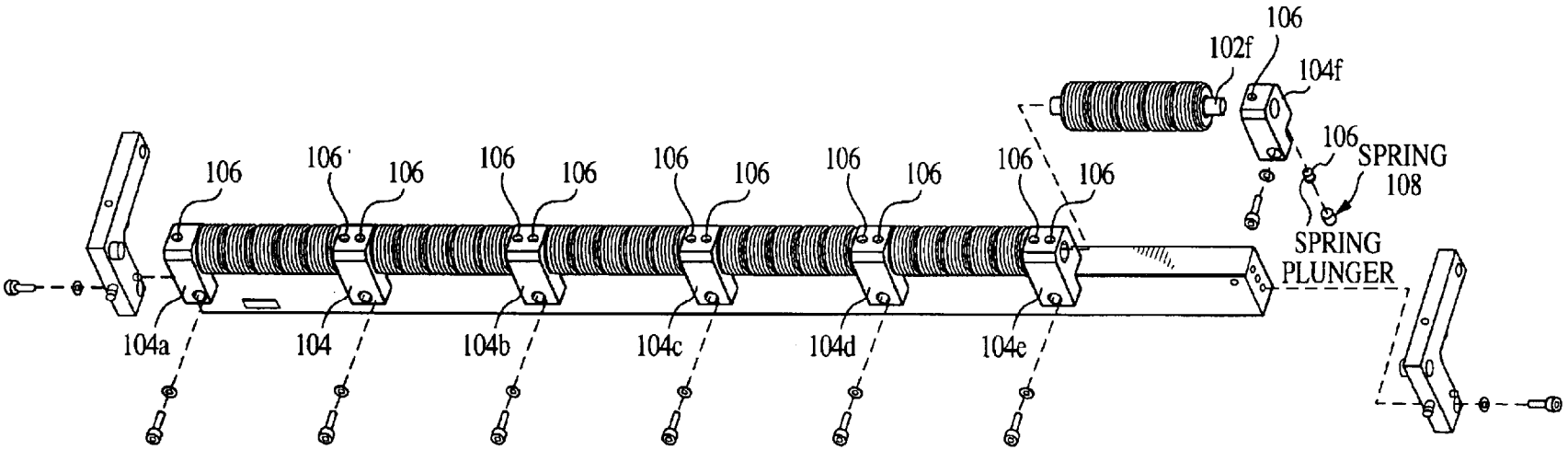
FIG. 3B is an exemplary perspective view of the upper roller arrangement of the platesetter imaging system, showing the use of springs in keeping the rollers in contact with the medium.

FIG. 3B is an exemplary perspective view of the upper roller arrangement of the platesetter imaging system 90 of FIG. 1, showing the use of springs 108 and a associated spring plunger 106 for biasing the roller sections 100*a*–100*f* in a manner to facilitate contact with the media 11. Each of the face holes 106 associated with supports 104*a*–104*f* have associated therewith a spring 108 and plunger 106 arrangement that explicitly shown in connection with roller 102*f*. That is, each shaft 102*a*–102*f* has at opposing ends thereof a spring 108 and plunger 108 assembly as explicitly shown with regard to roller 102*f*. It is preferred that a plunger 106 contact each respective shaft 102*a*–102*f*, and that at least one spring 108 contact each support 104*a*–104*f*, as determined by the number of face holes 106 associated with each respective support 104*a*–104*f*.

Figure 4:
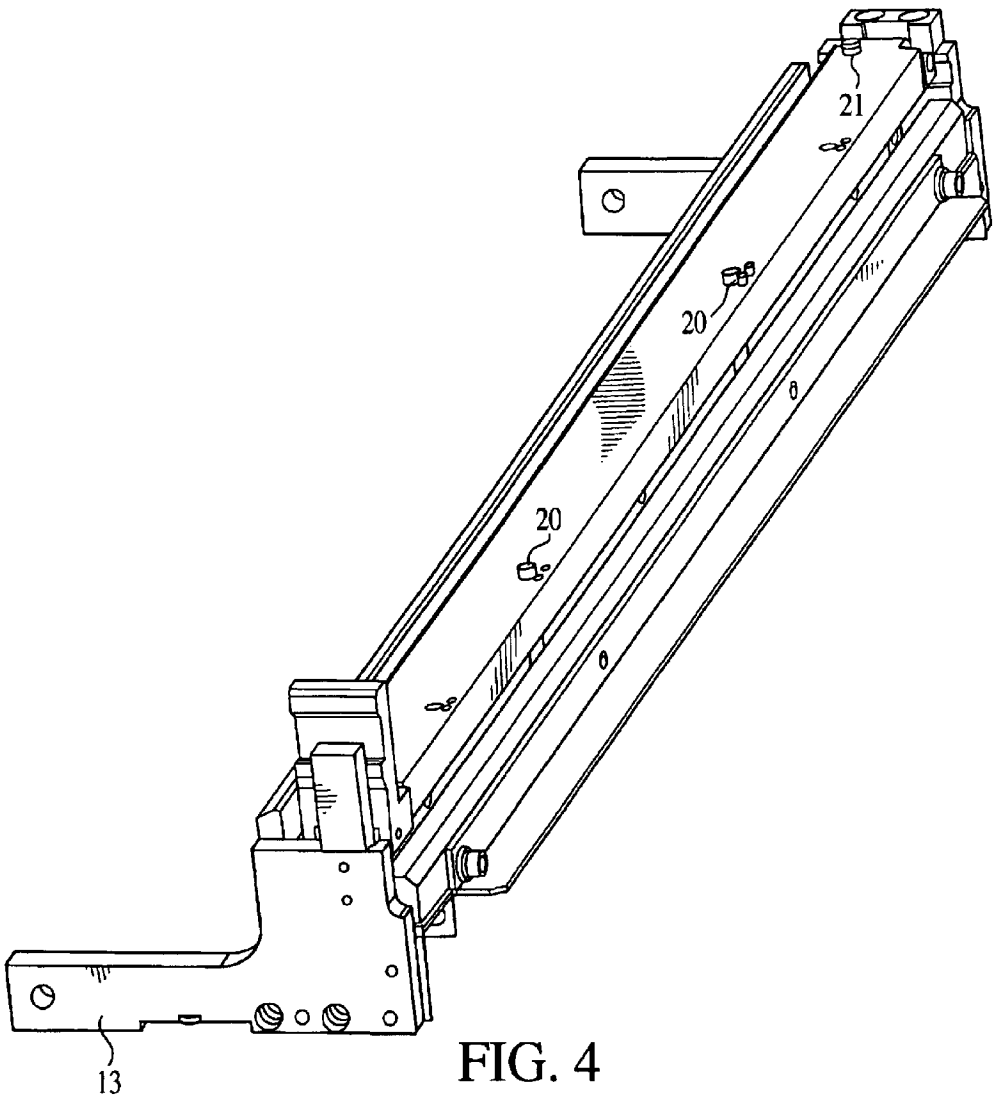
FIG. 4 is an exemplary perspective view illustrating the alignment pins shown in FIG. 1.

FIG. 4 is a perspective view illustrating an exemplary arrangement of the alignment pins 20, 21, used in conjunction with registration, shown in FIG. 1. The pins 21, 22 are preferably configured so as to align with at least some conventional and commercially available media 11 sizes. The pins 20, 21 are also preferably moveable in order to accommodate different medium 11 sizes.

Figure 5:
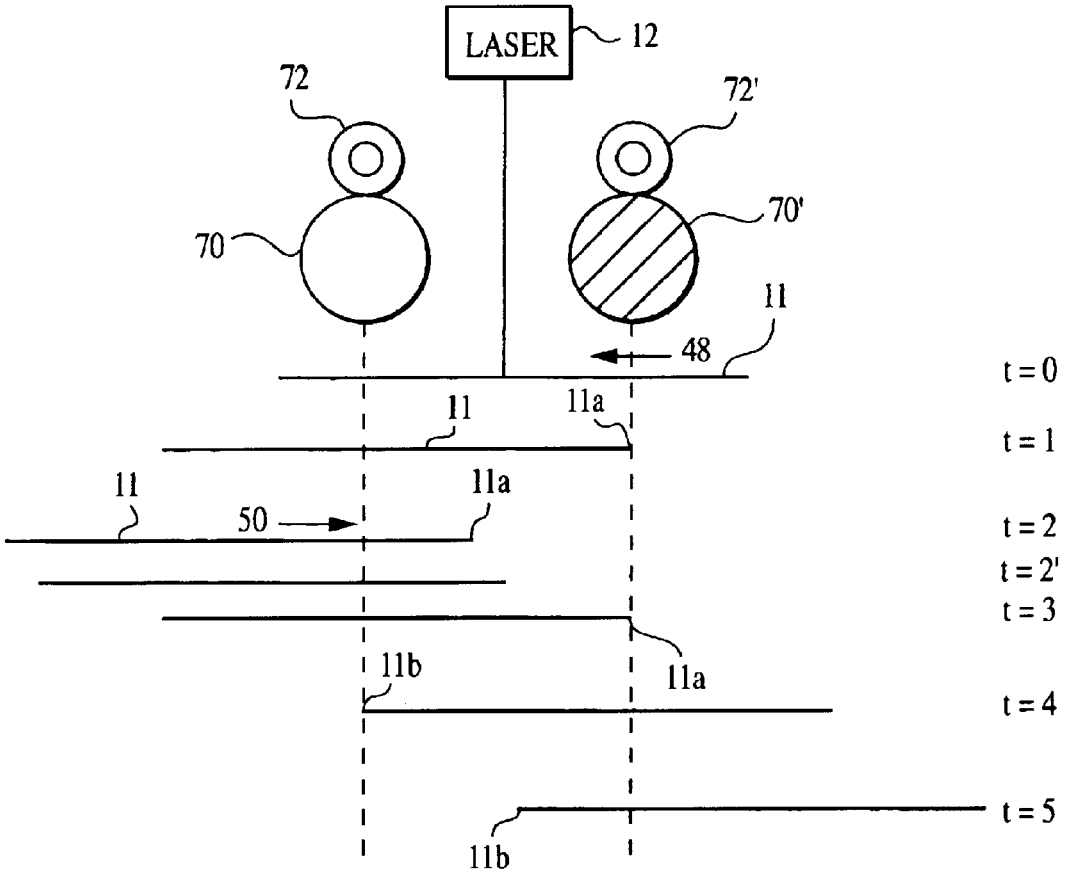
FIG. 5 is an exemplary diagram showing the sequence of operation in transporting a recording medium during an imaging operation.

FIG. 5 is an exemplary diagram showing the sequence of operation in transporting a medium 11 during an imaging operation. When lever 22 is in a vertical position as shown in FIG. 1, rollers 70, 72 and 70', 72' are separated so that media 11 can be positioned between the rollers. Lever 22 is mechanically linked to cams 4, 4', and 15. At the initial position (t=0), with lever 22 in a vertical position as shown in FIG. 1, the forward edge 11 a of medium 11 can be positioned to contact the alignment pins 20 and/or 21 to register the medium 11 with the platesetter 90 in a conventional manner known in the art.

Subsequent to registration and still at t=0, movement of lever 22 approximately 45 degrees in a counterclockwise direction operates cams 4 and 4' so that rollers 70, 72 and 70', 72' contact the surface of the medium 11. Movement of the lever 22 an additional 45 degrees (i.e., a total of 90 degrees counterclockwise from the position shown in FIG. 1) operates cam 15 so that alignment pins 20 and/or 21 are lowered to a position below the horizontal plane which the medium 11 traverses.

When the imaging process commences, the medium 11 moves to the left as indicated by the arrow 48. At or shortly after time t=1, the leading edge 11*a* of the medium 11 looses contact with roller 70'. It is preferred that movement of the medium 11 continue in the direction of arrow 48, to a position t=2 so that driven rollers 70, 70' can achieve their respective steady state angular velocities prior to the leading edge 11*a* reaching the image plane as shown at t=2a.

Subsequent to t=2, the direction of rotation of the rollers 70, 72 and 70', 72' reverses, as indicated by arrow 50. In order to avoid imaging artifacts at and subsequent to t=3, the gain of controller 36 should be adjusted accordingly to take into account the speed at which the medium 11 is being transported.

The medium 11 is in contact with both rollers 70', 72' until or shortly after t=4, at which point the trailing edge 11*b* of the medium 11 looses contact with roller 70. Subsequent to t=4, roller 70' moves the medium until imaging is completed. It is also possible that imaging may be completed prior to time t=4. At t=5, or before if imaging is not performed up to the trailing edge 11*b*, laser 12 can be turned off as the trailing edge 11*b* of the medium 11 has crossed the imaging plane. Rollers 70' and 72' preferably continue rotating until the medium is received on exit tray 26.

Figure 6:
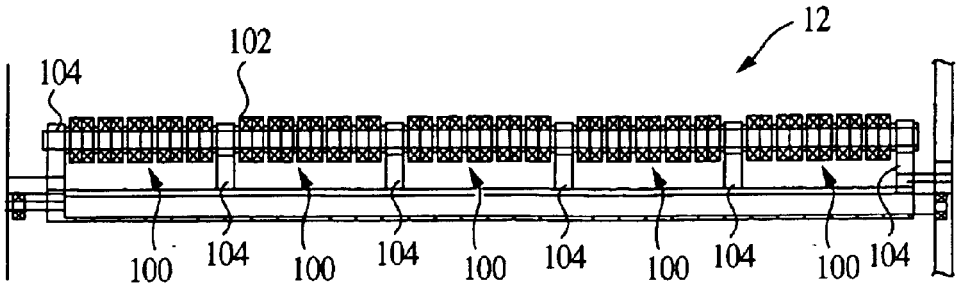
FIGS. 6 and 7 are side views of a small roller in the system of FIG. 1.
Figure 7:
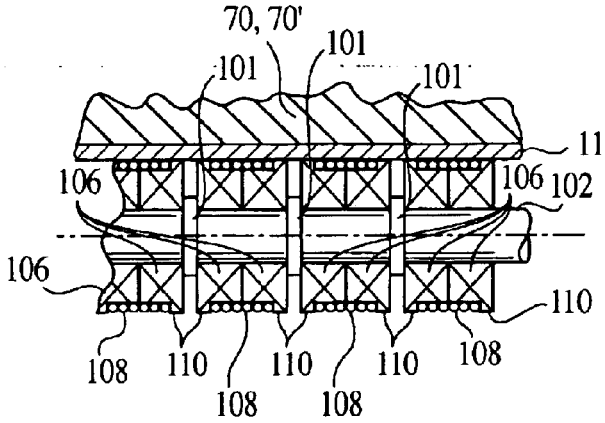
Figure 8:
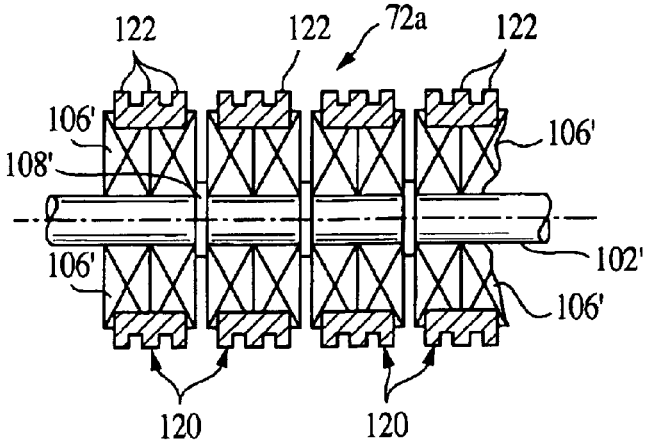
FIG. 8 is a side view of an alternative embodiment of a small roller of FIGS. 6 and 7.

FIGS. 6–8, discussed below, are discussed in U.S. Pat. No. 5,754,913, which is incorporated herein by reference. FIGS. 6 and 7 illustrate the construction of rollers 72, 72', which preferably utilize a soft rubber. As shown, rollers 72, 72' include preferably have five axially-spaced roller sections 100, all of which are mounted coaxially on a common shaft 102. Shaft 102 is mounted for rotation with supports 104 that are both at the ends of shaft 102, and also intermediate adjacent pairs of roller sections 100. Each roller section 100 preferably includes five split bearings 106 (FIG. 7), each of which has an outer circumferential surface which carries, for example, six O-rings 108. An annular flange 110 is provided at opposite ends of each split bearing 106 in the axial direction to maintain O-rings 108 in place. Spacing washers 101 are preferably provided between each pair of split bearings 106, and also preferably between split bearings 106 at the ends of each section 100 and adjacent supports 104. As illustrated somewhat schematically in FIG. 7, medium 11 is pinched between roller 70 and the outer surfaces of the O-rings 108 of roller 72.

FIG. 8 illustrates an alternative embodiment in which the non-driven roller, designated 72*a*, includes ribbed molded rubber rings 120 rather than O-rings 108. In the embodiment of FIG. 8, each ring 120 preferably fits tightly around the periphery of a bearing 106', and spacers 108' are preferably provided between adjacent bearings 106. As shown, each rubber ring 120 preferably includes a number of axially-spaced, radially-projecting annular ribs 122, with a space between each rib that is about the same as, or slightly less than, the width of the rib. When roller 72*a* is used, the medium 11 is pinched between the outer circumferential surfaces of ribs 122 and rollers 70, 70'.

Figure 9:
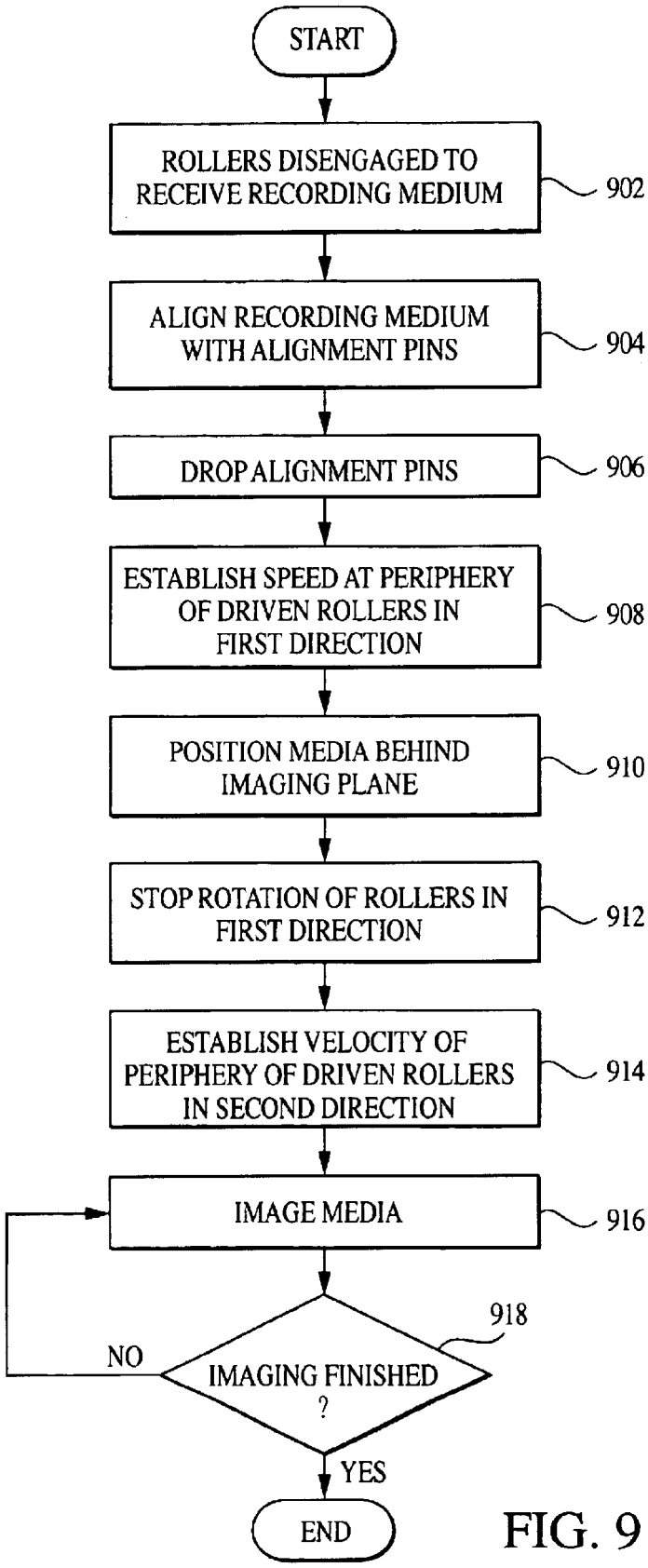
FIG. 9 is an exemplary flow chart of a method in accordance with the present 7 invention.

FIG. 9 is an exemplary flowchart in accordance with the present invention. At step 902 the process begins by ensuring that rollers 70, 72 and 70', 72' are separated by an amount sufficient to receive the medium 11 therebetween. As discussed, this can be done in at least one embodiment by, for example, placing lever 22 in a vertical position. At step 904, the medium is manually aligned with the alignment pins 21, 22 in conjunction with the registration process, as previously described.

At step 906, the alignment pins 21, 22 can be dropped to facilitate unobstructed movement of the medium across, for example, the platen 6. As previously discussed, the alignment pins 20, 21 can be dropped by moving lever 22 ninety degrees counterclockwise to a horizontal position. At step 908, the speed of the periphery of each roller 70, 70' is measured or obtained by, for example, controller 36 as previously discussed. In at least one embodiment, the first direction of rollers 70, 70' is counterclockwise when viewed looking at FIG. 1. At step 910, media 11 is positioned behind rollers 70, 70' to enable each of the rollers 70, 72 and 70', 72' to achieve their respective steady state speeds (i.e., angular velocity).

At step 912, the driven rollers 70, 70' are preferably, but optionally stopped. At step 914 the speed of the periphery of each roller 70, 70' is measured and established in the second direction by, for example, controller 36 and motors 19, 19', as previously discussed. The speed of each roller 70, 70' should be as close as possible. It is also preferred that the speed of each roller 70, 70' be the same in each direction (i.e., clockwise and counterclockwise when viewed from FIG. 1). In at least one embodiment, the second direction of rollers 70, 70' is clockwise when viewed looking at FIG. 1. At step 916, imaging of media 11 begins.

At decision step 918, a determination is made whether imaging has been completed. If imaging has not been completed imaging continues per step 916. If it is determined that imaging has been completed in the second direction, the process ends.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention. While the foregoing invention has been described in detail by way of illustration and example of preferred embodiments, numerous modifications, substitutions, and alterations are possible without departing from the scope of the invention defined in the following claims.

Having thus described our invention, what we claim as new and desire to secure by Letters Patent is as follows:

1. In a platesetting system that receives a recording medium and records an image on the received medium as the medium is transported through the system, a drive assembly for transporting the medium comprising:

a first driven roller having a precision diameter;

a second driven roller having a precision diameter;

a first non-driven roller having an outer surface substantially centered in a vertical position about said first driven roller;

a second non-driven roller having an outer surface substantially centered in a vertical position about said second driven roller;

a first motor operationally connected to said first driven roller;

a second motor operationally connected to said second driven roller; and a controller receiving as input the speed of an outer surface of said first and second driven rollers and optionally adjusting the speed of at least one of said first and second motors to provide a substantially same speed at the outer surface of said first and second rollers for transporting the medium at he substantially same speed in first and second opposing directions as determined by simultaneous counterclockwise and clockwise rotation, respectively, of each of said first and second driven rollers.

2. The system of claim 1, further comprising a first cam and a second cam used to engage said first and second non-driven rollers with the medium positioned between said first non-driven roller and said first driven roller and said second non-driven roller and said second driven roller to transport the medium in first and second directions in response to rotation of said first and second driven rollers.

3. The system of claim 1, wherein an outer surface of said first and second non-driven rollers comprises a plurality of axially-spaced annular ribs.

4. The system of claim 3, wherein a first portion of said axially-spaced annular ribs rotate about a first shaft, and a second portion of said axially-spaced annular ribs rotate about a second shaft.

5. The system of claim 4, wherein said first and second shafts are biased in a direction of the medium.

6. The system of claim 4, wherein at least two springs are used to bias each of said first and second shafts.

7. The system of claim 3, wherein the annular ribs comprise a plurality of axially aligned and closely spaced O-rings.

8. The system of claim 3, wherein at least a majority of the annular ribs of said first and second non-driven rollers have a circumferential surface that is axially-displaceable while in contact with the medium.

9. The system of claim 3, wherein the annular ribs comprise at least one molded ribbed ring having a number of greater diameter portions separated by lesser diameter portions.

10. The system of claim 1, wherein said first and second non-driven rollers include a shaft and a plurality of axially spaced roller sections coaxially mounted on the shaft.

11. The system of claim 1, wherein said first non-driven roller includes a plurality of first roller sections and a plurality of first axially-aligned independent shafts, wherein each first roller section rotates about a respective first shaft; and said second non-driven roller includes a plurality of second roller sections and a plurality of second axially-aligned independent shafts, wherein each second roller section rotates about a respective second plurality of axially aligned independent shafts shaft.

12. The system of claim 1, wherein an outer surface of said first and second non-driven rollers comprises a material that is soft relative to the material comprising an outer surface of said first and second driven rollers.

13. The system of claim 1, wherein a material defining an outer surface of said first and second non-driven rollers is resilient.

14. The system of claim 13, wherein the material is rubber.

15. The system of claim 11, wherein each of the roller sections comprise a plurality of axially aligned bearings.

16. The system of claim 15, wherein at least some of the bearings are circled by a plurality of axially aligned and abutting O-rings.

17. The system of claim 15, wherein at least some of the bearings are circled by at least one molded ribbed ring having a number of greater diameter portions separated by lesser diameter portions.

18. The system of claim 16, wherein each of the first and second non-driven roller sections has an annular flange at each axial end thereof for maintaining the O-rings in place.

19. The system of claim 1, wherein the medium contacts:

said first and second driven and non-driven rollers while the medium is moving in the first direction; and said first driven and non-driven rollers during a first portion of the image recording while moving in the second direction.

20. The system of claim 19, wherein the medium contacts:

said first and second driven and non-driven rollers during a second portion of the image recording while the medium is moving in the second direction; and said second driven and non-driven rollers during a third portion of the image recording while the medium is moving in the second direction.

21. The system of claim 1, wherein a rotational axis of said first driven roller is mounted substantially parallel to a rotational axis of said second driven roller, and wherein a rotational axis of said first non-driven roller is mounted substantially parallel to a rotational axis of said second non-driven roller.

22. The system of claim 1, wherein at least a portion of the image extends substantially from a leading edge of the medium to a trailing edge of the medium.

23. The system of claim 1, wherein said first and second motors operate at a plurality of speeds.

24. The system of claim 23, wherein a gain of said controller is adjusted to account for motor speed.

25. In a system that receives a recording medium and records an image on the received medium as the medium is transported through the system, a drive assembly for transporting the medium comprising: "a first pair of rollers, comprising"

a first driven roller, for transporting the medium, having a precision diameter and capable of rotating about a first axis in first and second opposing directions; and a first non-driven roller having an axis of rotation that has a first horizontal offset and a first vertical offset from an axis of rotation of said first driven roller;

a second pair of rollers, comprising:

a second driven roller, for transporting the medium, having a precision diameter and capable of rotating about a second axis in first and second opposing directions, in concert with said first driven roller, the speed at the diameter of said first and second driven rollers being substantially the same; and a second non-driven roller having an axis of rotation that has a second horizontal offset and second vertical offset from an axis of rotation of said second driven roller; wherein at least one of said first driven and non-driven rollers and said second driven and non-driven rollers contact the medium while the image is recorded on the medium.

26. The system of claim 25, further comprising:

a first motor operationally connected to said first driven roller;

a second motor operationally connected to said second driven roller; and a controller receiving as input the speed of an outer surface of said first and second driven rollers and optionally adjusting the speed of at least one of said first and second motors to provide a substantially same speed at the outer surface of said first and second rollers for transporting the medium at the substantially same speed in each of the first and second opposing directions.

27. The system of claim 26, further comprising a first cam and a second cam used to engage said first and second non-driven rollers with the medium positioned between said first non-driven roller and said first driven roller and said second non-driven roller and said second driven roller to transport the medium in the first and second directions in response to rotation of said first and second driven rollers.

28. The system of claim 25, wherein said first horizontal offset is in a direction in which the medium is received in the system.

29. The system of claim 28, wherein the first horizontal offset is approximately ten thousandths of an inch.

30. The system of claim 25, wherein said second horizontal offset is in a direction in which the medium exits from the system.

31. The system of claim 30, wherein the second horizontal offset is approximately ten thousandths of an inch.

32. The system of claim 25, wherein an outer surface of said first and second non-driven rollers comprises a plurality of axially-spaced annular ribs.

33. The system of claim 32, wherein a first portion of said axially-spaced annular ribs rotate about a first shaft, and a second portion of said axially-spaced annular ribs rotate about a second shaft.

34. The system of claim 33, wherein said first and second shafts are biased in a direction of the medium.

35. The system of claim 33, wherein at least two springs are used to bias each of said first and second shafts.

36. The system of claim 32, wherein at least a majority of the annular ribs of said first and second non-driven rollers have a circumferential surface that is axially-displaceable while in contact with the medium.

37. The system of claim 36, wherein the annular ribs comprise a plurality of axially aligned and closely-spaced O-rings.

38. The platesetting system of claim 32, wherein the annular ribs comprise at least one molded ribbed ring having a number of greater diameter portions separated by lesser diameter portions.

39. The system of claim 25, wherein an outer surface of said first and second non-driven rollers comprises a material that is soft relative to the material comprising an outer surface of said first and second driven rollers.

40. The system of claim 25, wherein a material defining an outer surface of said first and second non-driven rollers is resilient.

41. The system of claim 40, wherein the material is rubber.

42. The system of claim 25, wherein said first and second non-driven rollers include a shaft and a plurality of axially spaced roller sections coaxially mounted on the shaft.

43. The system of claim 25, wherein:

said first non-driven roller includes a plurality of first roller sections and a plurality of first axially-aligned independent shafts, wherein each first roller section rotates about a respective first shaft; and said second non-driven roller includes a plurality of second roller sections and a plurality of second axially-aligned independent shafts, wherein each second roller section rotates about a respective second shaft.

44. The system of claim 43, wherein each of the roller sections comprise a plurality of axially aligned bearings.

45. The system of claim 44, wherein at least some of the bearings are circled by a plurality of axially aligned and abutting O-rings.

46. The system of claim 44, wherein at least some of the bearings are circled by at least one molded ribbed ring having a number of greater diameter portions separated by lesser diameter portions.

47. The system of claim 45, wherein each of the first and second non-driven roller sections has an annular flange at each axial end thereof for maintaining the O-rings in place.

48. The system of claim 25, wherein the medium contacts:

said first and second driven and non-driven rollers while the medium is moving in the first direction; and said first driven and non-driven rollers during a first portion of the image recording while moving in the second direction.

49. The system of claim 48, wherein the medium further contacts:

said first and second driven and non-driven rollers during a second portion of the image recording while the medium is moving in the second direction; and said second driven and non-driven rollers during a third portion of the image recording while the medium is moving in the second direction.

50. The system of claim 25, wherein a rotational axis of said first driven roller is mounted substantially parallel to a rotational axis of said second driven roller, and wherein a rotational axis of said first non-driven roller is mounted substantially parallel to a rotational axis of said second non-driven roller.

51. The system of claim 25, wherein at least a portion of the image extends from a leading edge of the medium to a trailing edge of the medium.

52. The system of claim 26, wherein said first and second motors operate at a plurality of speeds.

53. The system of claim 52, wherein a gain of said controller is adjusted to account for motor speed.

54. The system of claim 25, wherein a rotational axis of said first driven roller is mounted substantially parallel to a rotational axis of said first non-driven roller, and wherein a rotational axis of said second driven roller is mounted substantially parallel to a rotational axis of said second non-driven roller.

55. The system of claim 25, wherein the recording medium comprises at least one of a plastic sheet and a metal sheet.

56. The system of claim 25, wherein said first non-driven roller is positioned above said first driven roller, and wherein said second non-driven roller is positioned above said second driven roller.

57. In a platesetting system that receives a recording medium and records an image on the received medium as the medium is transported through the system, a drive assembly for transporting the medium comprising:

a first driven roller having a precision diameter;

a second driven roller having a precision diameter;

a first non-driven roller, having an axis of rotation that is in substantial alignment with said first driven roller for transporting the media, having an outer surface comprising at least a first and second set of axially-spaced annular ribs, the first set rotating about a first shaft, and the second set rotating about a second shaft axially aligned with the first shaft;

a second non-driven roller, having an axis of rotation that is in substantial alignment with said second driven roller for transporting the media, having an outer surface comprising at least a third and fourth set of axially-spaced annular ribs, the third set rotating about a third shaft, and the fourth set rotating about a fourth shaft aligned with the third shaft;

a first motor operationally connected to said first driven roller; and a second motor operationally connected to said second driven roller.

58. The system of claim 57, further comprising a controller receiving as input the speed of an outer surface of said first and second driven rollers and optionally adjusting the speed of at least one of said first and second motors to provide a substantially same speed at the outer surface of said first and second rollers for transporting the medium at the substantially same speed in the first and second opposing directions as determined by simultaneous counterclockwise and clockwise rotation, repsectively, of each of said first and second driven rollers.

59. The system of claim 57, wherein said first, third and fourth shafts are biased in a direction of the medium.

60. The system of claim 57, wherein at least two springs are used to bias each of said first, second, third and fourth shafts.

61. The system of claim 57 wherein said first and second motors operate at a plurality of speeds.

62. The system of claim 61, wherein a gain of said controller is adjusted to account for motor speed.

* * * * *